US005561510A

United States Patent [19]

Kamp et al.

[11] Patent Number: 5,561,510

[45] Date of Patent: Oct. 1, 1996

[54] IMAGE FORMING METHOD UTILIZING INTERMEDIATE TRANSFER

[75] Inventors: Dennis R. Kamp, Spenceport; Thomas N. Tombs, Brockport, both of N.Y.

[73] Assignee: Eastman Kodak Company, Rochester, N.Y.

[21] Appl. No.: 381,245

[22] Filed: Jan. 31, 1995

[51] Int. Cl.[6] ..... G06G 15/14

[52] U.S. Cl. ..... 355/272; 355/271; 355/273; 355/274

[58] Field of Search ..... 355/271–276; 430/126

[56] References Cited

U.S. PATENT DOCUMENTS

| | | | |
|---|---|---|---|
| 4,688,925 | 8/1987 | Randall | 355/319 |
| 4,714,939 | 12/1987 | Ahern et al. | 355/275 |
| 5,070,369 | 12/1991 | Mahoney et al. | 355/271 |
| 5,070,372 | 12/1991 | Randall | 355/272 |
| 5,084,735 | 1/1992 | Rimai et al. | 355/271 |
| 5,087,945 | 2/1992 | Randall | 355/272 |
| 5,138,389 | 8/1992 | Randall | 355/272 |
| 5,150,161 | 9/1992 | Bujese | 355/256 |
| 5,187,526 | 2/1993 | Zaretsky | 355/273 |
| 5,300,989 | 4/1994 | Shakib | 355/272 X |
| 5,370,961 | 12/1994 | Zaretsky et al. | 430/126 |
| 5,410,392 | 4/1995 | Landa | 355/271 |
| 5,420,662 | 5/1995 | Gerstner | 355/271 X |

*Primary Examiner*—Matthew S. Smith
*Attorney, Agent, or Firm*—Leonard W. Treash, Jr.

[57] ABSTRACT

A toner image is transferred from an image member to a receiving sheet through first and second intermediate members. The first intermediate member is optimized for transfer from the photoconductor and has greater affinity for the toner than does the second intermediate member, which is optimized for transfer to the receiving sheet. This three transfer system provides transfer improvement over two transfer systems.

7 Claims, 2 Drawing Sheets

IMAGE FORMING METHOD UTILIZING INTERMEDIATE TRANSFER

This invention relates to the formation of toner images on a receiver sheet and, more specifically, to the transfer of toner images from a primary imaging member to the receiving sheet. Although not limited thereto, the invention is particularly usable in the transfer of toner images made up of small particles, for example, particles less than 10 microns, and particularly less than 6 microns in diameter (mean volume diameter).

Intermediates have been suggested for use in toner transfer for a number of reasons, most of them architectural. The following are some examples:

U.S. Pat. No. 5,070,369, granted Dec. 3, 1991 to is Mahoney et al, is an example of a large number of references which show the use of an intermediate to collect two or more different color toner images in registration, thereby forming a multicolor toner image on the intermediate that can be transferred in a single step to a receiving sheet. This approach has many advantages, including eliminating the problematic need to recirculate the receiving sheet to accumulate the images.

U.S. Pat. No. 5,070,372, granted Dec. 3, 1991 to Randall, shows the use of an intermediate to combine toner images on a photoconductive image member that were originally on separate frames on the same image member. Again, the combined toner image can be transferred in a single step to the receiving sheet.

U.S. Pat. No. 5,087,945, granted Feb. 11, 1992 to Randall, shows the use of two intermediates to combine toner images from four primary image members. The use of two intermediates reduces the overall size of the device.

U.S. Pat. Nos. 4,668,925, granted Aug. 25, 1987 to Randall, and 4,714,939, granted Aug. 7, 1986 to Ahern et al, show various schemes using an intermediate to accomplish the formation of duplex images without recirculation of a receiving sheet. The Ahern et al patent also shows a color version in which the colors are accumulated on the intermediate.

U.S. Pat. No. 5,150,161 shows a device in which electrostatic images are developed by a liquid toner, and the resulting toner image is then transferred through two intermediates to a receiving sheet. The succession of intermediates appear to be used for treatment and improvement of the liquid image for its final transfer.

U.S. Pat. No. 5,138,389, granted Aug. 11, 1992 to Randall, shows a combination high speed printer and relatively low speed full color apparatus in which two intermediates are used in the full color mode to fit with the architecture of the high speed machine and use the same paper path.

The resolution of toner images is heavily dependent upon the size of toner particle used. Typical office copiers and printers use toner particles 5 having a mean volume diameter of 11 or 12 microns. Such particles transfer readily electrostatically. However, in seeking higher resolution, attempts to transfer smaller sized particles electrostatically have proved troublesome because ordinary surface forces have a tendency to dominate the electrostatic forces. Even particles as large as 9½ microns are noticeably more difficult to transfer than are 12 micron particles. Highest quality color reproduction requires particles less than 6 microns in diameter, for example, particles as small as 3.5 microns and less. These particles are extremely difficult to transfer electrostatically.

U.S. Pat. No. 5,084,735, granted to Rimai et al Jan. 28, 1992. deals with the problem of picking an intermediate that readily receives toner from a photoconductor but also readily gives it up to a receiver. In its preferred embodiment, excellent results were obtained with relatively small particles using an intermediate roller having a compliant blanket covered by a very thin outer skin or overcoat of harder material. The compliant blanket helps pick up the toner from the primary image member while the hard outer overcoat provides good release characteristics for transfer to a paper receiver. Good results were achieved with toner particles as small as 7 microns. Some improvement was even noted with toner particles as large as 12 microns.

U.S. Pat. No. 5,187,526, granted Feb. 16, 1993 to Zaretsky, deals with a method and apparatus similar to that of the Rimai et al patent and suggests the use of an intermediate that has a resistivity less than $10^9$ ohm-cm. It also suggests a fairly high resistance backing member for transfer of the toner image to the receiver, for example, $10^{10}$ ohm-cm or greater. This patent also suggests a hard overcoat for the backup roller to prevent the pickup of toner. U.S. Pat. No. 5,370,961, granted Dec. 6, 1994 to Zaretsky et al, suggests further improvements in intermediate rollers in terms of the softness or hardness of the blanket and skin and the size of the toner particles being transferred. The Rimai et al, Zaretsky and Zaretsky et al patents are hereby incorporated by reference herein.

The Rimai et al patent points out the tradeoff necessarily faced by an intermediate. It must be able to receive toner from the primary image member but also must be able to give it up to the receiver. The Rimai et al, Zaretsky and Zaretsky et al approaches show remarkable results in fitting into this window. Although transfer is excellent, there is still room for subtle visible improvements in highest quality imaging, especially with small particle size toner.

SUMMARY OF THE INVENTION

It is an object of the invention to provide an image forming apparatus and method utilizing intermediate transfer in which the transfer itself is improved.

This and other objects are accomplished by a method and apparatus of forming a toner image on a receiving sheet which includes or performs a series of steps. A toner image is formed on a primary image member, for example, a photoconductive image member. The toner image is transferred from the primary image member to a first intermediate member in the presence of an electrical field urging such transfer. The toner image is transferred from the first intermediate member to a second intermediate member in the presence of an electrostatic field urging such transfer. The toner image is then transferred from the second intermediate member to a receiving sheet in the presence of an electrostatic field urging that transfer. The first and second intermediate members are made of materials such that the first intermediate member has greater affinity for the toner than does the second intermediate member.

According to a preferred embodiment, each of the intermediate members is made with a compliant blanket covered by a relatively harder thin overcoat or outer skin. However, the thickness and/or hardness of the blanket and/or the overcoat are chosen so that the first intermediate member is more attractive to the toner than is the second intermediate member. For example, the blanket in the first intermediate can have a Youngs modulus less than the Youngs modulus of the second intermediate. Alteratively, the overcoat on the second intermediate can be significantly harder and/or thicker than that of the first intermediate overcoat.

According to a further preferred embodiment, while the invention provides visibly improved transfer with toner particles as large as 9.5 microns, its results are much more remarkable compared to the prior art when transferring more difficult to transfer particles less than 6 microns in diameter, including toner images having particle size as small as 3.5 microns.

Because of the good results received using the process disclosed in the Rimai et al patent, the improvements are subtle. However, they are obtained despite an increase in the number of transfers from two to three and they are most noticeable the smaller the particle size.

DETAILED DESCRIPTION OF THE INVENTION

Reference will occasionally be made to particle size in microns. When this term is used, it refers to the mean diameter of the particle by volume. That is, an image having toner having a particle size of 10 microns would have 50 percent of its toner by volume greater than 10 microns in diameter and 50 percent of its toner by volume smaller than 10 microns in diameter.

Figure 1:
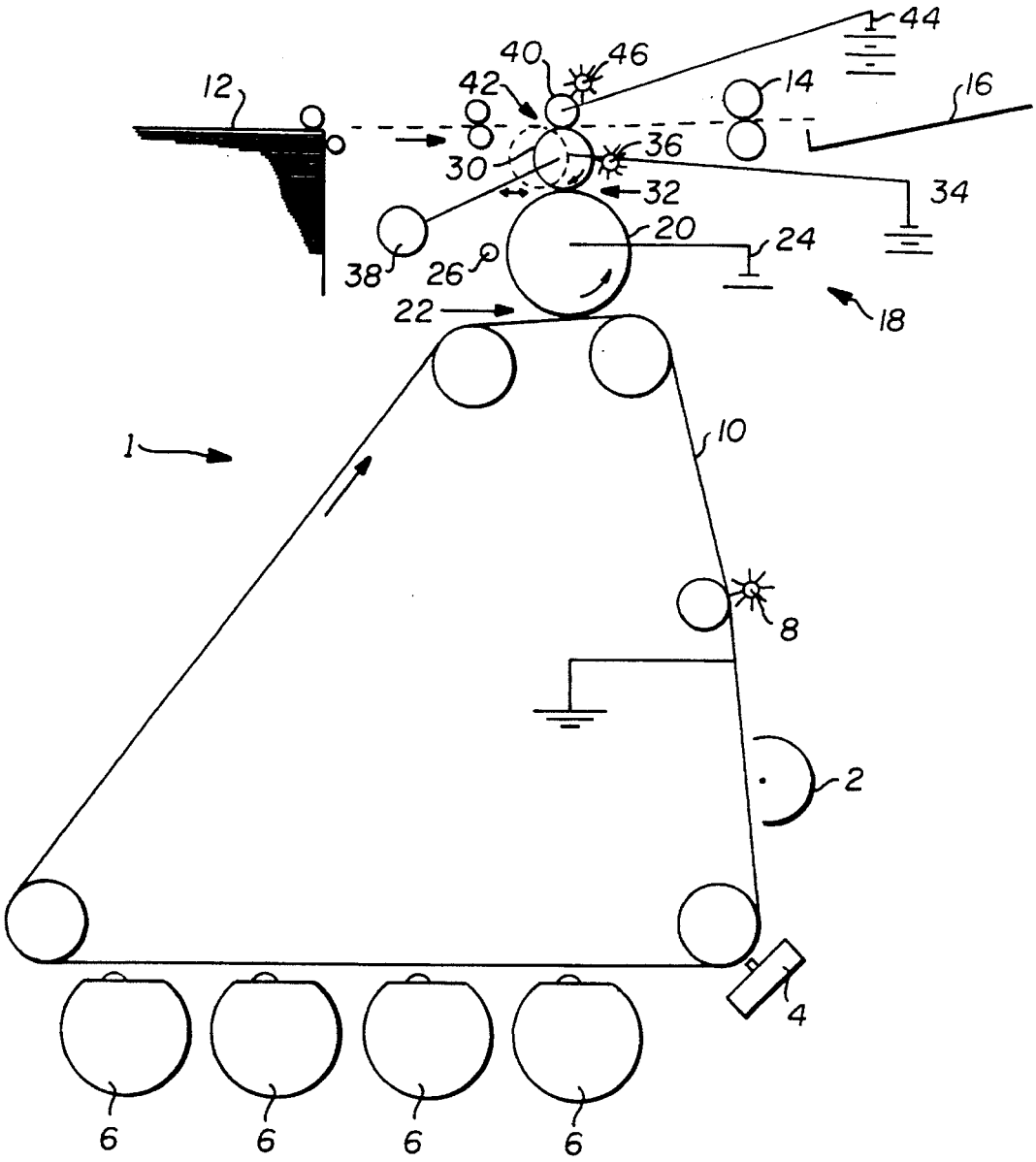
FIG. 1 is a side schematic of an image forming apparatus.

Referring to FIG. 1, an image forming apparatus 1 is shown which is a typical electrostatic image forming apparatus except for a transfer station 18. Image forming apparatus 1 includes a primary image member 10 in the form of an endless belt trained around a series of rollers. It also could be a drum type image member. Primary image member 10 is capable of having toner images formed on it. Usually, such an image member is photoconductive and uses a series of stations shown in FIG. 1. A charging station 2 lays down a uniform charge on image member 10. It is imagewise exposed by an exposing device, for example, a printhead 4 to create an electrostatic image. The electrostatic image is toned by one of the toning stations 6 to form a toner image. In some image forming apparatus, more than one toning station is available, allowing the formation of the toner image in one of a plurality of colors.

The toner image is transferred to a receiving sheet at the transfer station 18, and the image member is cleaned by a cleaning device 8 to make the process continuous.

Figure 3:
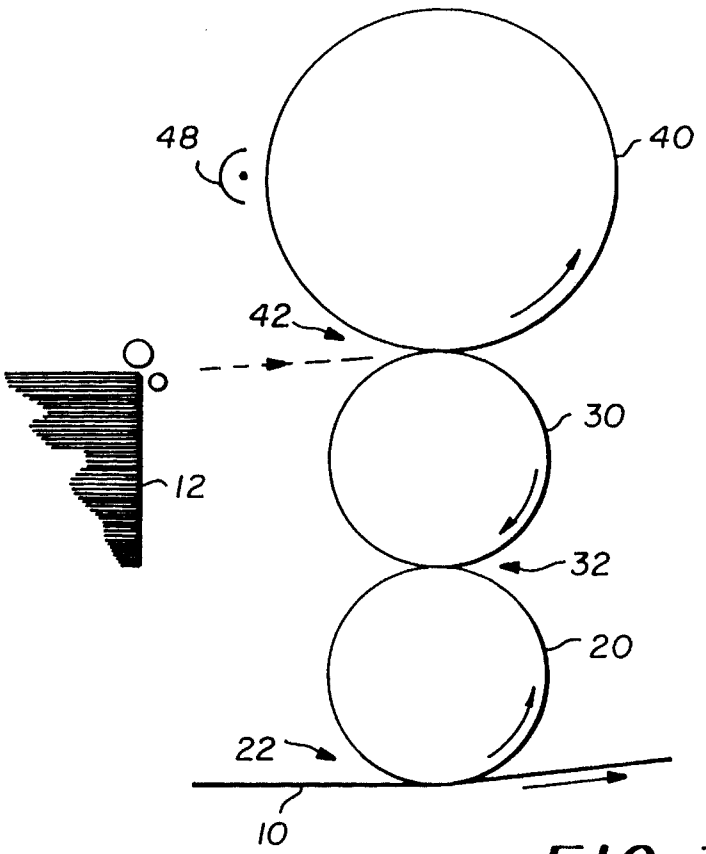
FIGS. 2 and 3 are side schematics of a transfer device.
Figure 2:
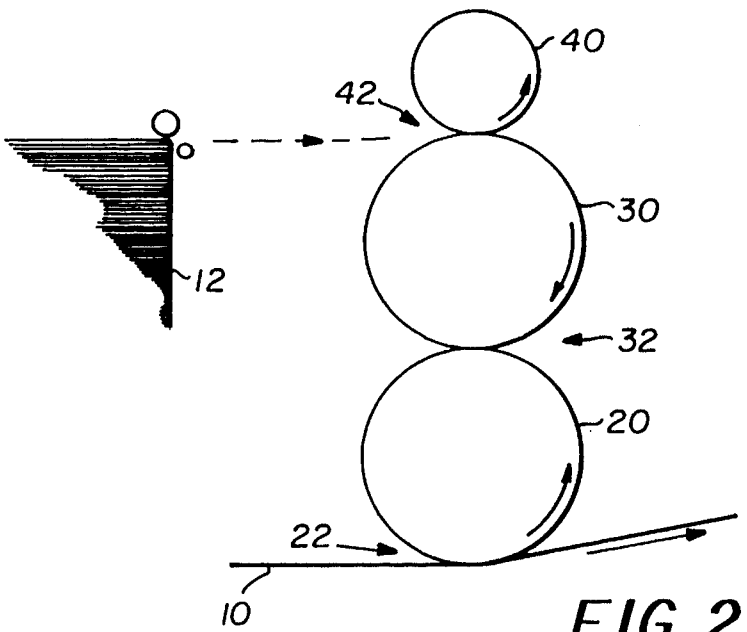
Figure 4:
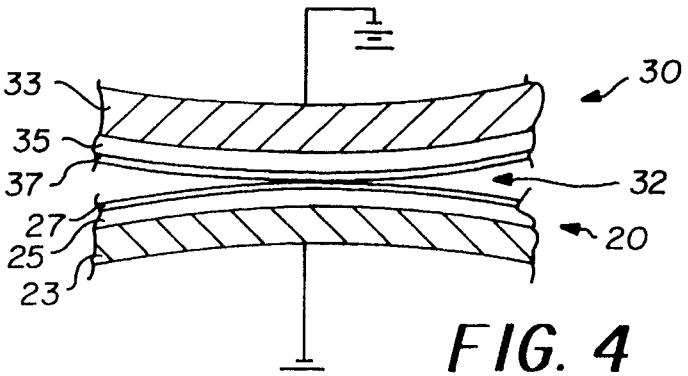
FIG. 4 is a side section of a nip area between two intermediate members. For clarity, some cross-hatching has been eliminated and member layers are not drawn to scale.

FIGS. 1, 2 and 3 each show a different embodiment of transfer station 18. In each of the embodiments, the toner image is transferred electrostatically from image member 10 to a first intermediate member 20 at a first transfer nip 22. The toner image is then transferred from the first intermediate member 20 to a second intermediate member 30 electrostatically at a second transfer nip 32. The toner image is then transferred electrostatically from the second intermediate member 30 to a receiving sheet fed from a receiving sheet supply 12 into a nip 42 formed between the second intermediate member and a backing member 40. While the embodiments shown in the FIGS. show the use of roller intermediates, endless webs are known intermediates and could be used as well. The backing member 40 can be replaced by a corona charger, as is well known in the art.

Although only shown in FIG. 1, in all embodiments, the intermediate members and the backing members may need to be cleaned from time to time. This is accomplished by cleaning devices 26, 36 and 46, respectively. The toner images are dry and each transfer is at ambient temperature. That is, no softening of the toner is used to help with transfer. If the toner is positive in charge, then the voltage sources 24, 34 and 44 are of progressively higher negative potential to create fields of the proper direction in each of the nips 22, 32 and 42, respectively.

According to FIG. 2, intermediate members 20 and 30 are relatively small and of substantially the same size. This arrangement is suitable for transferring a single color image which is larger in size than the circumference of either intermediate member. It is thus compact.

The FIG. 1 embodiment shows a larger first intermediate member 20 which has a circumference equal to the largest size intrack dimension of the images or image frames. With this embodiment, a series of toner images can be accumulated on the surface of image member 20, for example, to create a multicolor image. The multicolor image is then transferred in a single step to the second intermediate member 30 and is, in turn, transferred to the receiving sheet. Although not absolutely necessary, it is preferable that the second intermediate member in the FIG. 1 embodiment be articulatable by an articulation means 38 shown in FIG. 1 away from contact with the first intermediate member 20 during the accumulation of images on intermediate member 20. Alternatively, the intermediate members can be kept in contact and the field in nip 32 adjusted to prevent transfer to the second intermediate member 30 while the images are being accumulated on the first intermediate member 20.

Alternatively, different color toner images can be accumulated on intermediate member 30 and it can made large enough for that purpose. In this embodiment, intermediate member 20 can be much smaller.

FIG. 3 shows an embodiment in which backing member 40 also performs the function of being a third intermediate member for duplex. In this embodiment, a first image is transferred to intermediate image member 20, then to intermediate image member 30 and then to intermediate image member or backing member 40. A second image is transferred from first intermediate member 20 to second intermediate member 30 and a receiving sheet is fed into nip 42 to receive both images on opposite sides of the sheet simultaneously. The action at nip 42 in this particular embodiment is similar to that shown in U.S. Pat. No. 4,714,939, referred to above, which shows the use of an endless web intermediate to provide duplex in a nip with a photoconductive web.

Note that the FIG. 3 apparatus could also be used to provide a multicolor image on the topside of the receiving sheet by accumulating a series of images on the third intermediate member, backup member 40. Further, FIGS. 1 and 3 can be combined by making both intermediate member 20 and backup member 40 of a size adequate to accumulate images. With this structure, a first set of images is passed on through and accumulated on backup member 40 while a second set of images is accumulated on intermediate member 20 (or intermediate member 30) and the two composite images are transferred to opposite sides of the sheet simultaneously.

Intermediate webs can be used in the FIG. 3 embodiment to facilitate the final transfer to the receiving sheet by permitting an architecture in which the transfer of the two images is not done simultaneously but is done at different places along the path of the receiving sheet. If it is to be done simultaneously, as is most convenient with rollers and as is shown in FIG. 3, it is preferable to change the polarity of the charge on the toner on backup roller 40 using a corona source 48 so that a single field in nip 42 can transfer both toner images in opposite directions.

Referring again to FIG. 1 (as well as FIGS. 2 and 3), note that the receiving sheet fed from receiving sheet supply 12 is moving generally in the same direction from supply 12 to output tray 16 as is the primary image member 10 in the transfer area. The use of two intermediates, allows the design of an image forming apparatus with the receiving sheet supply placed where it is in FIG. 1. The advantage of such an architecture is small if the image forming apparatus is being designed in total. However, if a presently commercial image forming apparatus in which transfer is directly from an image member to a receiving sheet is being converted to the use of an intermediate, the use of the second intermediate allows the placement of the paper supply and rest of the receiving sheet path substantially as it is in the original apparatus. This a non-trivial advantage in the use of the second intermediate member.

In all of the embodiments shown, the image undergoes at least three transfers, a first transfer from the primary image member on which the toner image was formed to the first intermediate member, a second transfer from the first intermediate member to the second intermediate member and a third transfer from the second intermediate member to a receiving sheet. In the embodiment shown in FIG. 3, a fourth transfer is used. It is generally accepted that some toner is lost at each transfer. It would, thus, appear that a system with three transfers could not be as efficient as one with two transfers. However, if the intermediate members are optimized, as will be described below, a system with three transfers can, in fact, be made to provide better transferred images than comparable systems with two transfers.

In the prior art, which shows two transfer systems using a single intermediate member, the member's characteristics had to be chosen to fit in a window between its affinity for toner in the first transfer to the member and its release of toner in its second transfer away from the member. In the three transfer system, the first intermediate member is optimized for transfer to it and the second intermediate member is optimized for transfer to the receiving sheet. Thus, the first intermediate member is picked to have somewhat greater affinity for toner than the second intermediate member which is designed to have greater release characteristics. These designs provide improved transfer in nips 22 and 42. An improvement in the overall system is, therefore, obtained, providing the transfer at nip 32 does not detract more than the improvement gained from the other two transfers. However, a transfer between two intermediates made with smooth, consistent surfaces can be made under an electrostatic field with extremely high efficiency despite the fact that the first transfer member has greater affinity for the toner than does the second transfer member. This is true even with very small toner particles. In a three transfer system, the transfers that are difficult are the transfer from a primary image member 10, which often has varying localized conductivity patterns, to the first intermediate member 20 and the transfer from the second intermediate member 30 to a widely varying receiving sheet. In a three transfer system, the materials can be optimized for these two transfers (in nips 22 and 42) and less concern shown for the transfer in nip 32. The result is better overall transfer than a two transfer system. As mentioned above, the improvement is subtle, but persists with small particle size where subtle improvement is most noticeable.

Although the invention can be used in any intermediate transfer situation, best results are achieved using intermediate members similar to those shown in the Rimai et al patent referred to above. That is, overall transfer is improved using a relatively compliant blanket and a relatively hard overcoat on each of transfer members 20 and 30. The parameters associated with the overcoat and blanket are varied to provide more release in the second intermediate member and more affinity for toner in the first intermediate member.

According to an embodiment, the overcoat is left the same for intermediate members 20 and 30. For example, they may each have a Youngs modulus equal to or greater than $3\times10^7$ Pa but the characteristics of the blanket are altered to provide a somewhat harder blanket for the second intermediate member. For example, the blanket for the first intermediate member is made to have a Youngs modulus less than $2\times10^6$ Pa, while the blanket for the second intermediate member has a Youngs modulus of between $3\times10^6$ Pa and $10^7$ Pa. In each instance, the blanket is greater than 2 mm thick and the overcoat is less than 0.025 mm in thickness for best results, preferably less than 0.01 mm. The hardness of the backup roller is not critical.

Although adjusting the blanket's compliancy is the preferred approach, a similar result can be obtained by adjusting the hardness and/or thickness of the overcoat and/or the thickness of the blanket. A very thin overcoat is preferred in each instance.

Another advantage of a three transfer system over a two transfer system is that more versatility in the resistivity in each of the members is acceptable. For example, good results are achieved with a resistivity of materials as follows:

| ROLLER | LAYER | RESISTIVITY (ohm/cm) |
|---|---|---|
| First transfer member | blanket | $10^7$–$10^{11}$ |
| First transfer member | overcoat | $>10^6$ |
| Second transfer member | blanket | $10^7$–$10^{12}$ |
| Second transfer member | overcoat | $>10^6$ |
| Receiver backup | blanket | less than $10^{13}$ |

In the following Examples 1 and 2, a toner image was created electrophotographically on a conventional organic photoconductor. The toner image had latex toner particles with a mean particle size of 3.5 microns and minute silica particles to enhance transfer. The toner image was transferred from the photoconductor to a single intermediate image member which was in the form of a roller having an aluminum core and a blanket of polyurethane having a resistivity of $10^9$ ohm/cm. The blanket was overcoated with a 7 micron thick layer of Permuthane which is a polyurethane-like substance sold by Permuthane, Inc., a division of ICI, Inc., and having a Youngs modulus of $10^8$ Newtons/$m^2$ and a resistivity of approximately $10^{12}$ ohm/cm. The toner image was transferred to a quality clay coated paper.

EXAMPLE 1

In this example the intermediate blanket had a Youngs modulus of $10^8$ Pa. The transmission density of the toner transferred was measured and compared to the toner originally on the image member using a conventional densitometer. The transfer efficiency was calculated from the transmission density. The transfer efficiency in the first transfer was 98.8 percent and in the second transfer, 95.6 percent, providing a total transfer efficiency of 94.4 percent.

EXAMPLE 2

Example 2 was the same as Example 1 except that the blanket on the intermediate image member had a Youngs modulus of $3.8\times10^6$ Pa. In this instance, the transfer efficiency of the first transfer was 86.2 percent and of the second transfer was 100 percent, providing a total transfer efficiency of 86.2 percent.

EXAMPLE 3

In this example, using the same photoconductor and toner as in Examples 1 and 2, the intermediate image members of Examples 1 and 2 are combined as in FIG. 1 with the Example 1 intermediate receiving the image from image member 10 and the Example 2 intermediate transferring the image to the paper. With a transfer efficiency between the two rollers of virtually 100 percent, a total transfer efficiency of 98.8 percent is achieved, which is significantly higher than either of Examples 1 or 2.

From the above it can be seen that, by choice of materials, a three transfer system can be made more efficient than a two transfer system with comparable materials. Further, the other advantages of a three transfer system are also gained. For example, with a three transfer system, the receiver can be moved in the same direction as the primary image member.

The invention has been described in detail with particular reference to a preferred embodiment thereof, but it will be understood that variations and modifications can be effected within the spirit and scope of the invention as described hereinabove and as defined in the appended claims.

We claim:

1. A method of forming a toner image on a receiving sheet, said method comprising:

forming a toner image on an image member, transferring the toner image from the image member to a first intermediate member in the presence of an electrical field urging such transfer, transferring the toner image from the first intermediate member to a second intermediate member in the presence of an electrostatic field urging such transfer, transferring the toner image from the second intermediate member to a receiving sheet in the presence of an electrostatic field urging such transfer, characterized in that the steps of transferring the toner image to first and second intermediate members includes transferring the toner image to a first intermediate member that has greater affinity for the toner than does the second intermediate member.

2. The method according to claim 1 wherein the step of forming a toner image includes forming a toner image of toner particles having a mean particle size by volume of less than 10 microns.

3. The method according to claim 1 wherein the step of forming a toner image includes forming a toner image of toner particles having mean particle sizes by volume of less than 6 microns.

4. The method according to claim 1 wherein the second intermediate member has a harder surface than the first intermediate member.

5. The method according to claim 1 wherein the first and second intermediate members each include a blanket of at least 2 mm thick material having a Youngs modulus less than $10^7$ Newtons/$m^2$ and a very thin outer skin of a harder material having a Youngs modulus of $3\times10^7$ Newtons/$m^2$ or more.

6. The method according to claim 5 wherein the first intermediate member has a blanket having a Youngs modulus of $2\times10^6$ Newtons/m2 or less and the second intermediate member has a blanket having a Youngs modulus of $3\times10^6$ Newtons/$m^2$ or more.

7. The method according to claim 5 wherein the Youngs modulus of the blanket of the second intermediate member is at least two times as large as the Youngs modulus of the blanket of the first intermediate member.

* * * * *